US008869946B2

(12) United States Patent
Okada

(10) Patent No.: US 8,869,946 B2
(45) Date of Patent: Oct. 28, 2014

(54) EMERGENCY STOP DEVICE FOR ELEVATORS

(75) Inventor: Daisuke Okada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 211 days.

(21) Appl. No.: 13/502,749

(22) PCT Filed: Oct. 28, 2009

(86) PCT No.: PCT/JP2009/068497

§ 371 (c)(1),
(2), (4) Date: Apr. 19, 2012

(87) PCT Pub. No.: WO2011/052053

PCT Pub. Date: May 5, 2011

(65) Prior Publication Data

US 2012/0205198 A1 Aug. 16, 2012

(51) Int. Cl.

| | |
|---|---|
| ***B66B 5/04*** | (2006.01) |
| ***B66B 5/22*** | (2006.01) |
| ***B66B 5/18*** | (2006.01) |

(52) U.S. Cl.
CPC .... *B66B 5/22* (2013.01); *B66B 5/18* (2013.01)
USPC ..... 187/350

(58) Field of Classification Search
CPC ..... B66B 5/044; B66B 5/18; B66B 5/04; B66B 5/185; B66B 5/027
USPC ..... 187/350, 373
See application file for complete search history.

(56) References Cited

U.S. PATENT DOCUMENTS 1,479,574 A * 1/1924 Zetterlund ..... 187/257
2,298,167 A * 10/1942 Rissler ..... 187/352

(Continued)

FOREIGN PATENT DOCUMENTS

CN 1339012 A 3/2002
EP 1 568 643 A1 8/2005

(Continued)

OTHER PUBLICATIONS

Office Action issued Nov. 6, 2013 in the corresponding Korean Patent Application No. 10-2012-7010729 (with English Translation).

(Continued)

*Primary Examiner* — William A Rivera
*Assistant Examiner* — Michael Riegelman
(74) *Attorney, Agent, or Firm* — Oblon, Spivak, McClelland, Maier & Neustadt, L.L.P.

(57) ABSTRACT

An emergency stop device for elevators which actuates when an abnormal speed in both ascending and descending directions of a car is detected by one governor. The emergency stop device includes an endless governor rope to perform circulation movement in synchronization with ascent and descent of the car, a governor in an upper part of the shaft that restrains circulation movement of the governor rope when the abnormal speed is detected via the governor rope, an emergency stop device body in the car that brakes the car when the abnormal speed is detected, a swinging body swingably provided in the emergency stop device body, connected to the governor rope, that rotates when the circulation movement of the governor rope is restrained, thereby causing the emergency stop device body to actuate, and a swinging body rotation mechanism which rotates the swinging body in a prescribed direction when the governor rope between the car and the governor has become slack.

2 Claims, 6 Drawing Sheets

(56) References Cited

U.S. PATENT DOCUMENTS

| | | | | |
|---|---|---|---|---|
| 3,908,801 | A * | 9/1975 | Pohlman | 187/313 |
| 4,083,432 | A * | 4/1978 | Lusti | 187/373 |
| 5,230,406 | A * | 7/1993 | Poon | 187/376 |
| 5,299,661 | A * | 4/1994 | Pramanik et al. | 187/373 |
| 5,323,877 | A * | 6/1994 | Mori | 187/375 |
| 6,564,907 | B1 * | 5/2003 | Sasaki | 187/373 |
| 6,619,435 | B1 * | 9/2003 | Watzke et al. | 187/373 |
| 7,080,717 | B2 * | 7/2006 | Ito | 187/350 |
| 7,905,328 | B2 * | 3/2011 | Windlin et al. | 187/286 |
| 2004/0262091 | A1 * | 12/2004 | Ito | 187/372 |
| 2009/0159373 | A1 * | 6/2009 | Hartman et al. | 187/350 |
| 2010/0163346 | A1 * | 7/2010 | Coquerelle et al. | 187/247 |

FOREIGN PATENT DOCUMENTS

| | | | |
|---|---|---|---|
| JP | 10 59649 | | 3/1998 |
| JP | 2001 316056 | | 11/2001 |
| JP | 2002 46955 | | 2/2002 |
| JP | 2002 120979 | | 4/2002 |
| JP | 2002 536273 | | 10/2002 |
| KR | 10-2004-0082375 | A | 9/2004 |
| WO | 03 008317 | | 1/2003 |
| WO | WO 2004/050525 | A1 | 6/2004 |

OTHER PUBLICATIONS

Combined Chinese Office Action and Search Report issued Nov. 18, 2013 in Patent Application No. 200980162148.2 (with partial English language translation).

International Search Report Issued Dec. 15, 2009 in PCT/JP09/68497 Filed Oct. 28, 2009.

Office Action issued Apr. 10, 2013, in Korean Patent Application No. 10-2012-7010729 with English translation.

English translation of the International Preliminary Report on Patentability issued Jun. 21, 2012, in PCT/JP2009/068497.

English translation of the Written Opinion of the International Searching Authority issued Dec. 15, 2009, in PCT/JP2009/068497.

Office Action issued Aug. 20, 2013 in Japanese Patent Application No. 2011-538153 (with partial English-language translation).

Office Action issued May 20, 2014, in Korean Patent Application No. 10-2012-7010729 with English translation.

Office Action issued Jun. 19, 2014 in Chinese Patent Application No. 2009801621482 w/partial English translation.

* cited by examiner

EMERGENCY STOP DEVICE FOR ELEVATORS

TECHNICAL FIELD

The present invention relates to an emergency stop device for elevators.

BACKGROUND ART

In conventional emergency stop devices for elevators, as a device which is intended to prevent a car from moving abruptly in an upward direction or a downward direction, a device is known which is equipped with a holder which is provided in a car or a counterweight of an elevator and has an inclined surface and a pressing surface in such a manner as to sandwich a guide rail, a pressing body movably provided between the inclined surface of the holder and the guide rail, and a solenoid which is actuated by inputting an electrical signal which is outputted when a speed detector detects an abnormal movement of the car, is connected to the pressing body, causes the pressing body to be spaced from the guide rail in normal operating times, and pushes the pressing body to between the inclined surface and the guide rail during braking (refer to Patent Literature 1, for example).

Moreover, as an emergency stop device for elevators which is such that in an upper part and a lower part thereof, two governors are provided, a device is known which is equipped with a loop-like governor rope which is circulated in association with the ascent and descent of a car, an upper governor which has an upper sheave on which the upper end portion of this governor rope is wound and is rotated by the circulation of the governor rope, and restrains the governor rope by detecting an overspeed during the run of the car, thereby causing the emergency stop device to actuate, and a lower governor which has a lower sheave on which the lower end portion of the governor rope is wound and is rotated by the circulation of the governor rope, and restrains the governor rope by detecting an overspeed during the run of the car, thereby causing the emergency stop device to actuate (refer to Patent Literature 2, for example).

And as an emergency stop device for elevators in which the overspeed of a car in both upward and downward directions is detected by use of an upper governor alone, a device is known which is equipped with an upper sheave serving also as a flywheel, a lower sheave pivotally supported on a tension weight, a governor rope wound between the upper sheave and the lower sheave, a flyweight having a claw portion protruding radially outward and rotatably arranged on the upper sheave point-symmetrically, an overspeed switch tripper in sliding contact with the claw portion of the flyweight provided on the upper sheave, an overspeed detection switch which is actuated by the oscillation of this overspeed switch tripper, a pair of actuating links which is symmetrically arranged, with the upper sheave held therebetween, and has a rope grip tripper, a movable jaw disengage ably connected to the actuating links, a fixed jaw which faces the movable jaw and comes into a standstill at a midpoint of the governor rope, and an actuating lever which is connected to the governor rope and connected to the actuating links of the emergency stop device of the elevator car (refer to Patent Literature 3, for example).

Furthermore, as an emergency stop device for elevators which is such that when breakage or slackness occurs in a suspension rope from which an elevator car is suspended, the car is brought into an emergency stop, a device is also known which is equipped with a rail which guides the car within a shaft, detection means which detects breakage or slackness of the suspension rope from which the elevator car is suspended, a roller which comes into contact with the rail and rotates in association with the ascent of the car when breakage or slackness is detected by this detection means, a girth which is provided coaxially with this roller and rotates with the roller, a rewinding rope one end of which is fixed to this girth and rewound on the girth in association with the rotation of the roller, and a braking member which is provided at the other end of this rewinding rope, displaces the position in association with the rewinding of the rewinding rope and stops the descent of the car by coming into pressure contact with the rail.

CITATION LIST

Patent Literature

Patent Literature 1: International Publication No. WO2003/008317

Patent Literature 2: Japanese Patent Laid-Open No. 2002-120979

Patent Literature 3: Japanese Patent Laid-Open No. 2002-046955

Patent Literature 4: Japanese Patent Laid-Open No. 10-059649

SUMMARY OF INVENTION

Technical Problem

However, in the conventional emergency stop device for elevators described in Patent Literature 1, the emergency stop device is actuated by use of an electromagnetic actuator (a solenoid) which is provided in a car and is actuated by inputting an electrical signal. Therefore, when the emergency stop device is actuated due to a trouble in actuation means (an electromagnet actuator) at an intermediate floor between halls, with the passengers kept in the car, it becomes necessary to rescue the passengers by moving the car to the nearest hall and to repair or replace the above-described actuating means, posing a problem that it takes a long time to rescue the passengers, which might increase the uneasiness of the passengers. In particular, when the above-described actuating means is arranged under the car, works to cope with the trouble, such as repair and replacement, require much manpower and time.

And, in the conventional emergency stop device for elevators described in Patent Literature 2, governors are provided in the upper part and lower part of a shaft. Therefore, this poses the problem that cost increases by providing two governors, and the problem that in the case where both the upper governor and the lower governor have detected an overspeed and actuated (the actuating claw of both speed governors are in engagement with a ratchet), it becomes necessary to perform restoration work of the both upper and lower governors, requiring manpower and time.

In contrast to this, in the conventional emergency stop device for elevators described in Patent Literature 3, an overspeed in the upward and downward directions of a car is detected by one governor provided in the upper part of a shaft. In this case, when an emergency stop device is actuated during the ascent of the car, the tension of a governor rope grasped by the upper governor acts on a safety gear activating mechanism via a tension pulley of the lower part of the shaft. And the tension pulley is provided in such a manner as to be movable vertically in order that a prescribed tension is obtained by a tension weight and, therefore, it is ensured that during the actuation of a safety gear, locking is performed in order to prohibit this vertical movement.

Therefore, because the distance from the place where the governor rope is grasped to the safety gear mechanism is long and there is an allowance of play of the lock mechanism which prohibits the elastic deformation of the governor rope and the upward movement of the tension pulley, the safety gear does not actuate unless the car moves as much as the distance to which the amount of elastic deformation and the allowance of play of the lock mechanism are added, posing the problem that actuation delays occur.

The present invention was made in order to solve such problems, and the object of the invention is to obtain an emergency stop device for elevators which can reduce actuation delays with a simple structure in an emergency stop device for elevators which is such that an emergency stop device is actuated in both ascending and descending directions through the use of one governor which detects an abnormal speed in both ascending and descending directions of a car.

Means for Solving the Problems

An emergency stop device for elevators according to the present invention, which actuates upon detection of an abnormal speed in both ascending and descending directions of a car and brakes the car, comprises: an endless governor rope which is provided in such a manner as to be capable of performing circulation movement in synchronization with the ascent and descent of the car; a governor which is provided in either an upper part or a lower part of the shaft of an elevator, on which one side of the governor rope is wound, detects the abnormal speed via the governor rope, and restrains the circulation movement of the governor rope when the abnormal speed is detected; a tension pulley which is provided in the other of the upper part or lower part of the shaft and on which the other end of the governor rope is wound; an emergency stop device body which is provided on the car and brakes the car by being actuated when the abnormal speed is detected; an swinging body which is swingably provided in the emergency stop device body, connected to the governor rope, and which rotates in the direction suited to the moving direction of the car when the circulation movement of the governor rope is restrained, to cause the emergency stop device body to actuate; and swinging body rotation means which rotates the swinging body in a prescribed direction when the circulation movement of the governor rope is restrained and the governor rope between the car and the governor has become slack.

Advantageous Effect of Invention

The emergency stop device for elevators of the present invention produces the effect that it is possible to reduce actuation delays with a simple structure in an emergency stop device for elevators which is such that an emergency stop device is actuated in both ascending and descending directions through the use of one governor which detects an abnormal speed in both ascending and descending directions of a car.

DESCRIPTION OF EMBODIMENT

The present invention will be described with reference to the accompanying drawings. Incidentally, in each of the drawings, numerals refer to identical parts or corresponding parts and overlaps of description of these parts are appropriately simplified or omitted.

Embodiment 1

Figure 1:
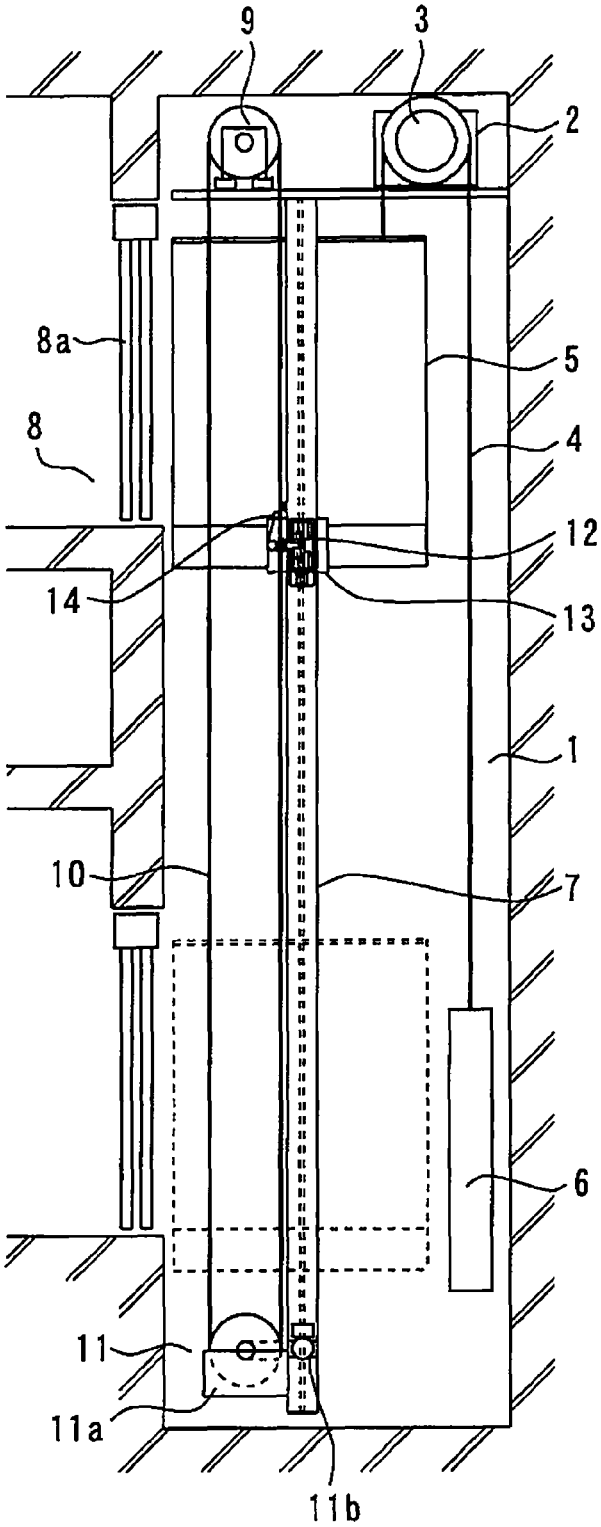
FIG. 1 is a diagram showing the general arrangement of an elevator including an emergency stop device for elevators related to a first embodiment of the present invention.
Figure 2:
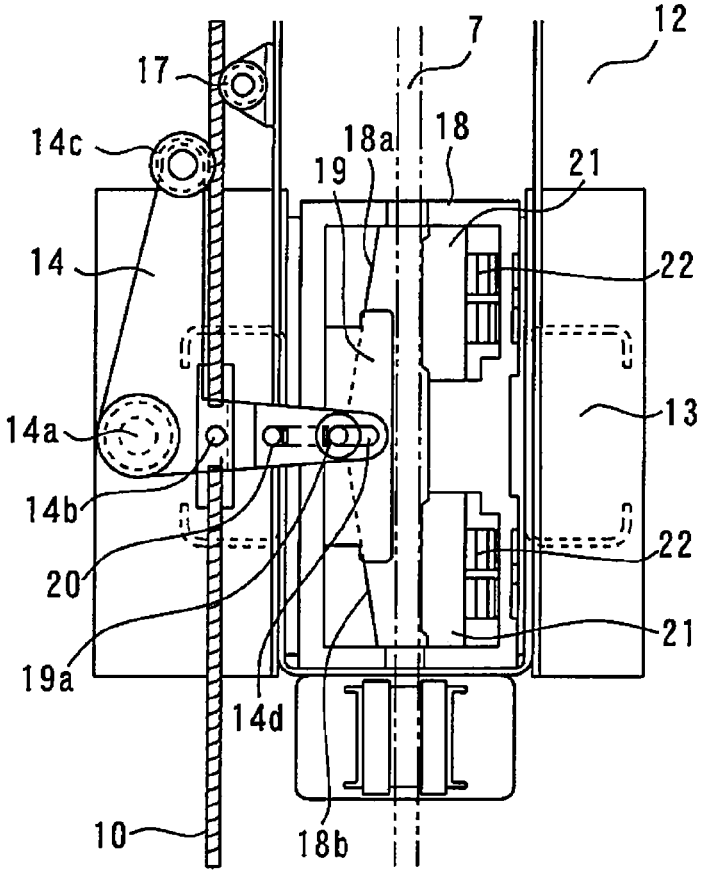
FIG. 2 is a front view showing the main part of the emergency stop device for elevators related to a first embodiment of the present invention.
Figure 3:
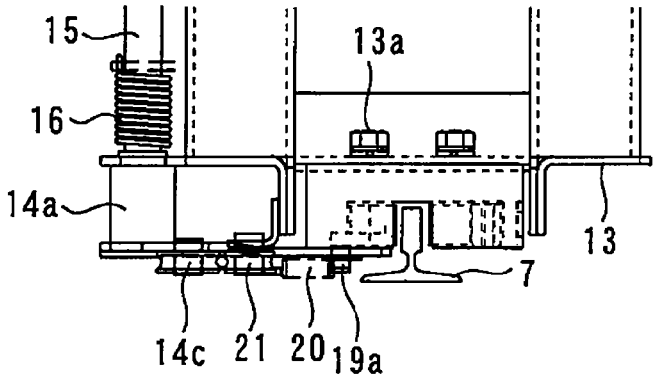
FIG. 3 is a projected view from above (plan view), showing the main part of the emergency stop device for elevators related to a first embodiment of the present invention.
Figure 4:
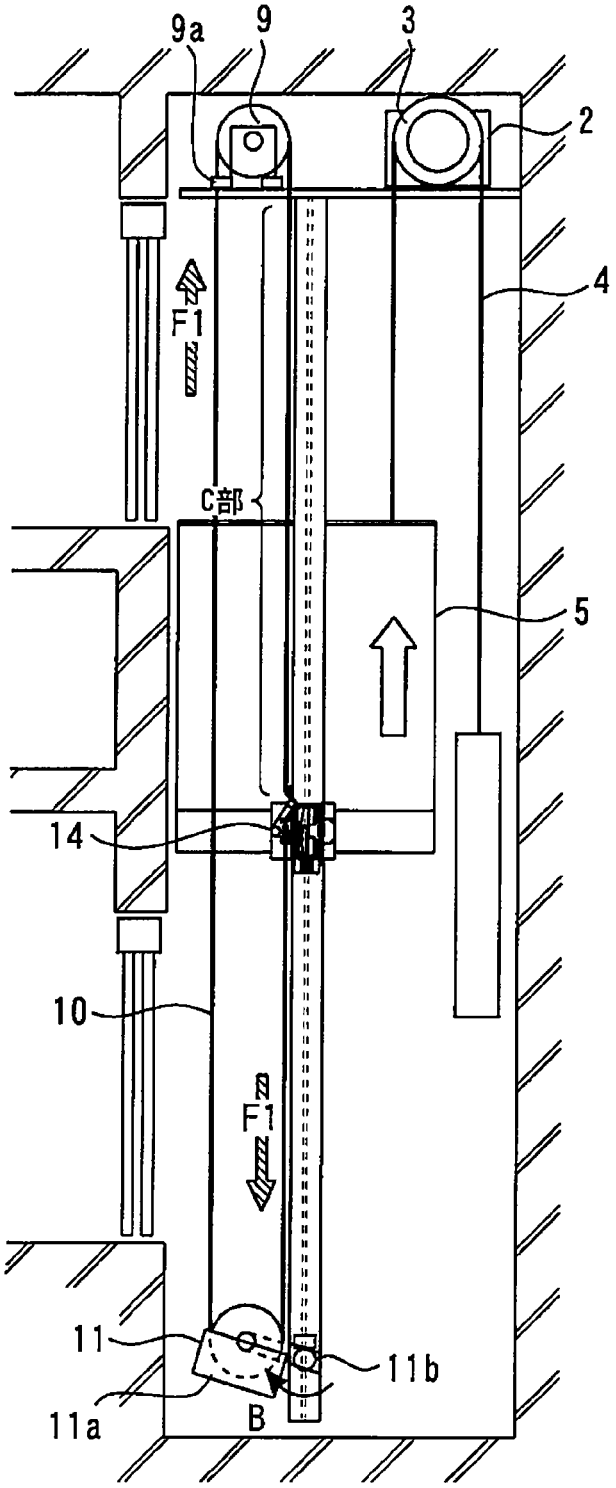
FIG. 4 is a general view of the elevator to explain the action of the emergency stop device for elevators during the ascent of a car, related to a first embodiment of the present invention.
Figure 5:
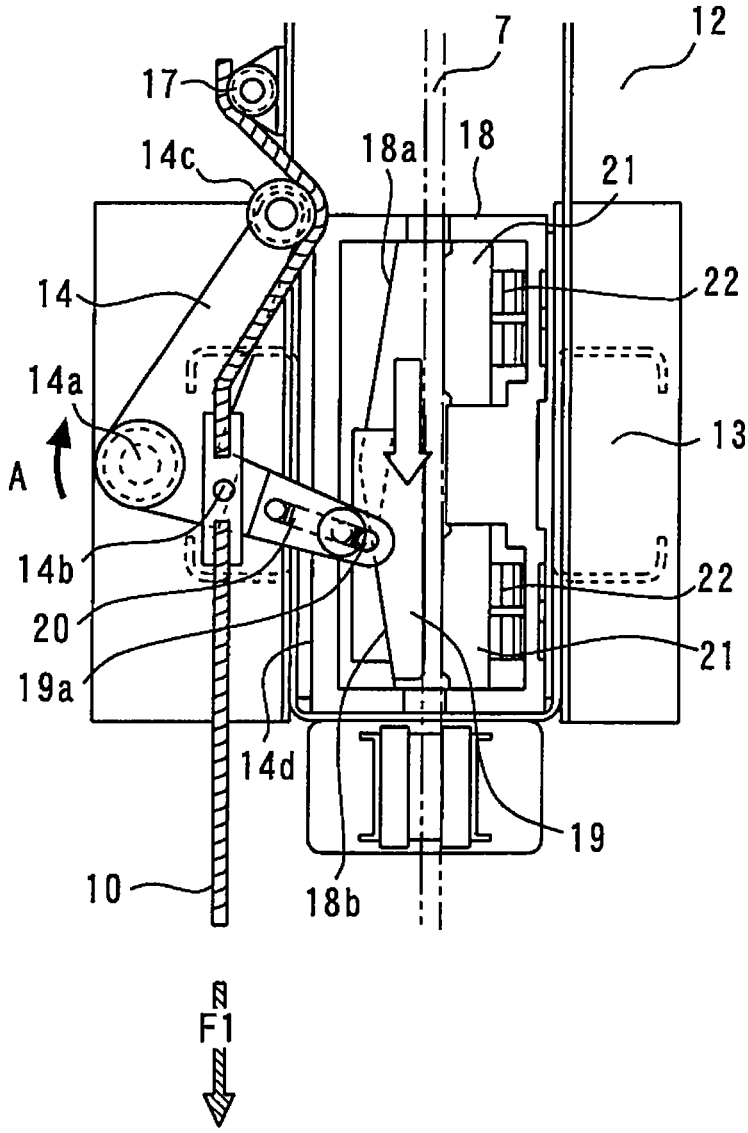
FIG. 5 is an expanded view of the main part of the emergency stop device to explain the action of the emergency stop device for elevators during the ascent of a car, related to a first embodiment of the present invention.
Figure 6:
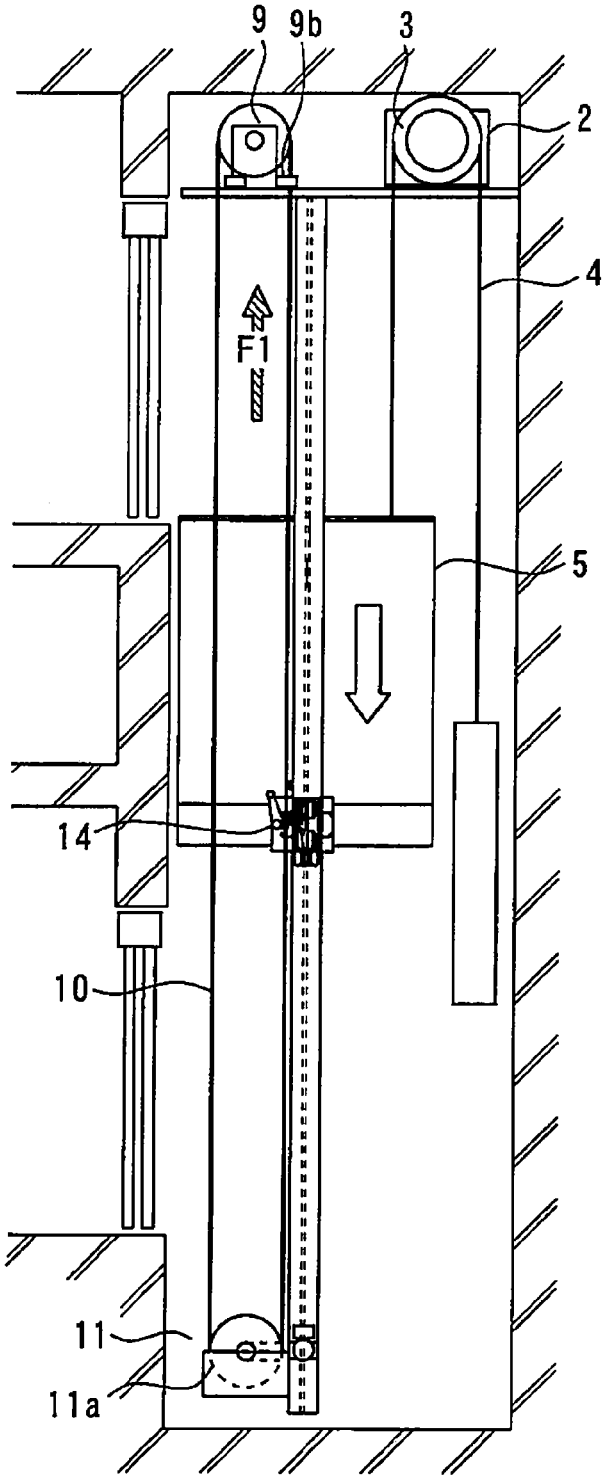
FIG. 6 is a general view of the elevator to explain the action of the emergency stop device for elevators during the descent of a car, related to a first embodiment of the present invention.
Figure 7:
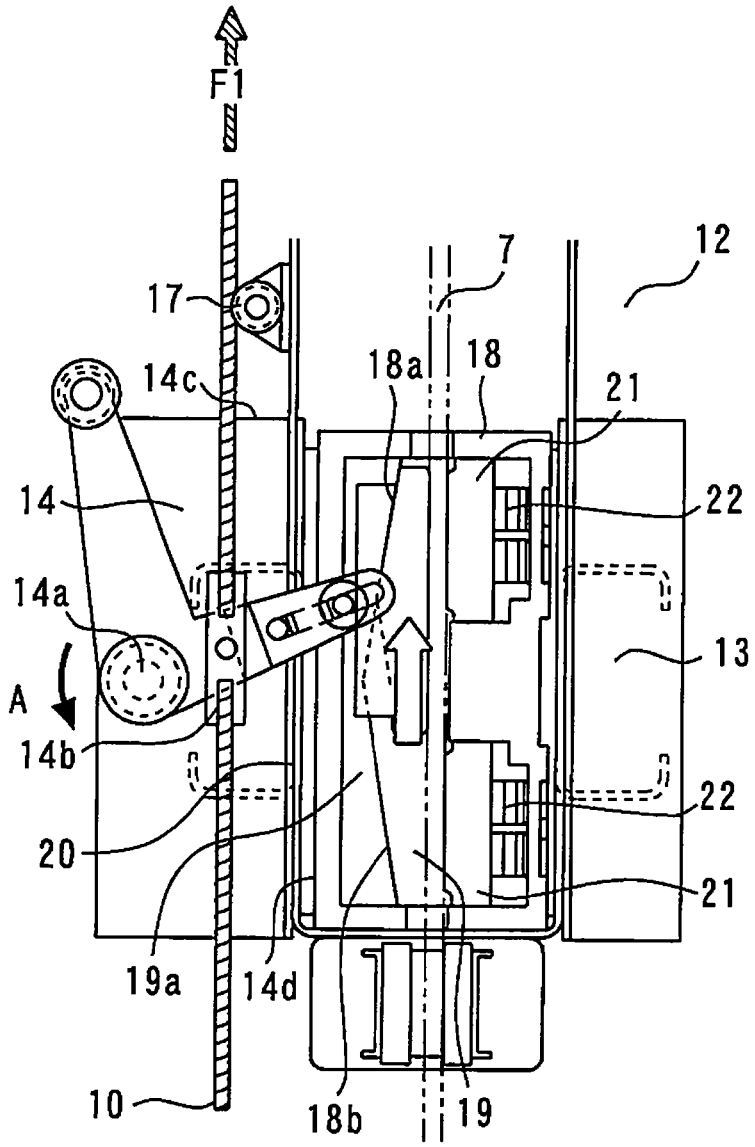
FIG. 7 is an expanded view of the main part of the emergency stop device to explain the action of the emergency stop device for elevators during the descent of a car, related to a first embodiment of the present invention.

FIGS. 1 to 7 relate to Embodiment 1 of the present invention. FIG. 1 is a diagram showing the general arrangement of an elevator including an emergency stop device for elevators. FIG. 2 is a front view showing the main part of the emergency stop device for elevators. FIG. 3 is a projected view from above (plan view), showing the main part of the emergency stop device for elevators. FIG. 4 is a general view of the elevator to explain the action of the emergency stop device for elevators during the ascent of a car. FIG. 5 is an expanded view of the main part of the emergency stop device to explain the action of the emergency stop device for elevators during the ascent of a car. FIG. 6 is a general view of the elevator to explain the action of the emergency stop device for elevators during the descent of a car. FIG. 7 is an expanded view of the main part of the emergency stop device to explain the action of the emergency stop device for elevators during the descent of a car.

In the figures, reference numeral 1 denotes a shaft of an elevator provided vertically in a building, and in the vicinity of the top part (the upper part) of this shaft 1, there is provided a traction machine 2 which drives the elevator. A main rope 4 is wound on a sheave 3 attached to a driving shaft of the traction machine 2, and a car 5 which ascends and descends in the shaft 1, with passengers and the like therein, is connected to one end of this main rope 4, whereas a counterweight 6 for compensating for the weight of the car 5 is attached to the other end, respectively.

In the shaft 1, there are arranged in a standing manner a pair of car guide rails 7 which engage slidably with the car 5 and a pair of weight guide rails (not shown) which engage slidably with the counterweight 6, respectively, and by driving the traction machine 2, the car 5 ascends and descends in the shaft 1 like a well bucket, the car being guided by the car guide rails 7 and the counterweight 6 being guided by the weight guide rails.

And a hall 8 is provided on a floor where the car 5 stops, and in a wall portion which separates the hall 8 from the shaft 1, there is provided a hall entrance and a hall door 8*a* which opens and closes this hall entrance.

In the vicinity of the top part (the upper part) of the shaft 1, there is provided a governor 9 which is configured to detect an abnormal speed in both directions of the ascending direction and descending direction of the car 5 and to perform action suited to the moving direction of the car 5.

Additionally, in the vicinity of the bottom part (the lower part) of the shaft 1, there is slidably provided a tension pulley 11 having a tension weight 11*a* via a tension pulley fixed shaft 11*b*, and an endless governor rope 10 is wound between the governor 9 and the tension pulley 11. A load is downwardly applied to the tension pulley 11 by the tension weight 11*a*, and gives prescribed tension to the governor rope 10.

And the governor 9 is provided with a grasping mechanism for ascent time 9*a* (a grasping mechanism for descent time 9*b*) which is actuated upon detection of an abnormal speed during the ascent (descent) of the car 5 via the governor rope 10, and restrains the circulation movement of the governor rope 10 by firmly grasping the governor rope 10.

On both sides of the lower part of the car 5, an emergency stop device body 12 is attached to each of the pair of car guide rails 7 so as to be opposed to each car guide rails 7, with an emergency stop frame 13 fixed by a bolt 13*a*.

A lifting lever 14 substantially in the form of the letter L as viewed from the front is attached to the emergency stop frame 13 in such a manner as to be slidable around a lever shaft 14*a*. The emergency stop device body 12 and the governor rope 10 are connected together via a connecting portion 14*b* in the vicinity of the middle of this lifting lever 14, and the governor rope 10 is configured to perform circulation movement between the governor 9 and the tension pulley 11 according to the ascending and descending speed of the car 5.

The lever shaft 14*a* of the lifting lever 14 provided in one emergency stop device body 12 out of the emergency stop device bodies 12 on both sides of the lower part of the car 5, is connected to one end of a connecting shaft 15. The lever shaft 14*a* of the lifting lever 14 provided in the other emergency stop device body 12, which is not shown, is connected to the other end of the connecting shaft 15, and the lifting levers 14 provided in both emergency stop device bodies 12 on both sides of the lower part of the car 5 swing in synchronization with each other.

One side of the letter L of the lifting lever 14 is on the upper side substantially along the governor rope 10, and a roller 14*c* is rotatably attached to the forward end of this one side. An elastic element 16 formed from a helical spring is provided on the connecting shaft 15, and this elastic element 16 urges the lifting lever 14 so that the lifting lever 14 is rotated in the direction in which the roller 14*c* is pushed against the governor rope 10 (i.e., clockwise in FIG. 2).

The urging force of the elastic element 16 is set so that the force with which the lifting lever 14 is rotated in the direction in which the roller 14*c*, which is urged by the elastic element 16, is pushed against the governor rope 10 is balanced with the prescribed tension of the governor rope 10 given by the tension weight 11*a* of the tension pulley 11.

In this manner, the roller 14*c* of the lifting lever 14 and the elastic element 16 of the connecting shaft 15 constitute swinging body rotation means which rotates the lifting lever 14 in a prescribed direction when the circulation movement of the governor rope 10 is restrained and the governor rope 10 between the car 5 and the governor 9 has become slack.

Additionally, a rope guide 17 which abuts against the governor rope 10 is rotatably attached somewhat above the roller 14*c* position on the side opposite to the roller 14*c*, with the governor rope 10 therebetween. In other words, this rope guide 17 is attached in such a manner as to abut against the governor rope 10 from the direction reverse to the direction in which the roller 14*c* presses the governor rope 10.

The rope guide 17 is provided in order to ensure that the roller 14*c* abuts positively against the governor rope 10 even when the tension of the governor rope 10 is weak in a slack condition, as a result of which, the relative positions of three points are fixed regardless of the car 5 position, the three points being the point at which the rope guide 17 abuts against the governor rope 10, the point at which the roller 14*c* abuts against the governor rope 10, and the point at which the connecting portion 14*b* is connected to the governor rope 10.

That is, it is ensured that the position of the car 5 does not affect the angular position of the lifting lever 14 in a balanced condition of the force with which the lifting lever 14 urged by the elastic element 16 is rotated and a prescribed tension of the governor rope 10.

In the emergency stop frame 13, a holder 18 which has the shape of a substantial concavity as viewed from above is provided in such a manner that the car guide rails 7 are opposed to each other across the interior of the concavity.

On the lifting lever 14 side in the interior of this concavity, there are provided two inclined surfaces formed to provide the substantial shape of the letter V as the front shape: a first inclined surface 18*a* and a second inclined surface 18*b*. The first inclined surface 18*a* and the second inclined surface 18*b* are connected together in the middle of the vertical direction of the holder 18, and are formed in such a manner that the gap from the car guide rail 7 side face becomes narrower from the middle portion with a wide gap from the car guide rail 7 side face toward both upward and downward directions.

The other side of the letter L of the lifting lever 14 is arranged in a direction substantially orthogonal to the governor rope 10, and on the above-described other side, a long-holed portion 14*d* is drilled along the longitudinal direction of this other side. A movable braking piece 19 having a pin portion 19*a* is connected to this long-holed portion 14*d* by the insertion of the pin portion 19*a* into the long-holed portion 14*d*. This pin portion 19*a* is slidable in the long-holed portion 14*d* in the long-hole direction.

The connecting portion 14*b* which connects the governor rope 10 and the lifting lever 14 together is rotatably attached to the other side of the above-described letter L as viewed from the lever shaft 14*a*.

The movable braking piece 19 is present in the concavity of the holder 18 and is arranged on the lifting lever 14 side with respect to the car guide rails 7.

And on the side of the movable braking piece 19 opposed to the holder 18, two inclined surfaces substantially parallel to the first inclined surface 18*a* and the second inclined surface 18*b* are formed to form a sharp angled part. On the side of the movable braking piece 19 opposed to the car guide rail 7 side face, there is formed a flat surface substantially parallel to the opposed car guide rail 7 side face.

On the counter lifting lever 14 side with respect to the car guide rails 7 in the concavity of the holder 18, there are provided a fixed braking piece 21 and a pressing element 22 formed from a helical compression spring, which urges this fixed braking piece 21 in the direction in which the fixed braking piece 21 is pushed to the car guide rail 7 side face.

Between the pin portion 19*a* of the movable braking piece 19 and the lifting lever 14, there is attached a helical tension spring 20 which urges the movable braking piece 19 via the pin portion 19*a* to the counter car guide rail 7 side. In a balanced condition of the force with which the lifting lever 14 urged by the elastic element 16 is rotated and a prescribed tension of the governor rope 10, thanks to the action of this helical tension spring 20, the bottom portion of the V-shaped inclined surface of the holder 18 and the top portion of the sharp-angled inclined surface of the movable braking piece 19 meet and the movable braking piece 19 is arranged in a position most spaced from the car guide rail 7 side face.

And when the lifting lever 14 swings around the lever shaft 14*a* from this balanced condition, the movable braking piece 19 slides upward or downward along the first inclined surface 18*a* or the second inclined surface 18*b* by the action of the long-holed portion 14*d* and the pin portion 19*a*. The movable braking piece 19 which has slid upward or downward bites into the gap between the first inclined surface 18*a* or the second inclined surface 18*b* and the car guide rail 7 side face, and the movable braking piece 19 and the fixed braking piece 21 support the car guide rail 7 in a sandwiching manner, whereby the car 5 is braked.

Thanks to the configuration described above, because in normal operating times, the force with which the lifting lever 14 urged by the elastic element 16 is rotated and a prescribed tension of the governor rope 10 are in a balanced condition and the rotation of the lifting lever 14 is prevented, the lifting lever 14 does not swing and is at a standstill. Therefore, the movable braking piece 19 does not move in the vertical direction along the first inclined surface 18*a* or the second inclined surface 18*b* and the movable braking piece 19 is arranged in a position most spaced from the car guide rail 7 side face, with the result that a prescribed gap size is ensured between the movable braking piece 19 and the car guide rail 7. Furthermore, because the movable braking piece 19 is constantly urged by the helical tension spring 20 in the direction in which the movable braking piece 19 is spaced from the car guide rail 7 side face, the emergency stop device is prevented from performing malfunction due to the influence of acceleration and deceleration and vibrations by the run of the car 5 in normal operating times.

And when an abnormal speed during the ascent of the car 5 has been detected by the governor 9 via the governor rope 10, a grasping mechanism for ascent time 9*a* is actuated and grasps the governor rope 10, with the result that the circulation movement of the governor rope 10 is restrained. When in this state the car 5 is to ascend further, the tension F1 shown in FIGS. 4 and 5 is generated in the governor rope 10. And slackness is generated in the governor rope 10 (portion C shown in FIG. 4) between the lifting lever 14 of the emergency stop device body 12 and the governor 9 in the amount corresponding to the amount of elastic deformation (elongation) of the governor rope 10 and the amount of upward movement of the tension pulley 11 (arrow B in FIG. 4).

When slackness is generated in the governor rope 10 on the upper side as viewed from the lifting lever 14, the tension of the governor rope 10 in the portion where the slackness has been generated becomes weaker than the above-described prescribed tension in a balanced condition, and the force with which the lifting lever 14 urged by the elastic element 16 is rotated becomes stronger. That is, the balance between these forces becomes lost, the urging force of the elastic element 16 causes the lifting lever 14 to rotate in the direction in which the roller 14*c* is pressed against the governor rope 10 (arrow A in FIG. 5).

Then the movable braking piece 19 slides downward along the second inclined surface 18*b* and bites into the gap between the second inclined surface 18*b* and the car guide rail 7 side face, and the movable braking piece 19 and the fixed braking piece 21 support the car guide rail 7 in a sandwiching manner, whereby the car 5 is braked.

The tension pulley 11 is slidably provided via the tension pulley fixed shaft 11*b*, i.e., movably in the direction in which the governor rope 10 becomes slack. However, on that occasion, it is ensured that with respect to the amount of upward movement of the tension pulley 11 (arrow B in FIG. 4), the movable amount of the tension pulley 11 is set to be the amount in which the governor rope 10 can slack so that the lifting lever 14 is rotatable in the amount necessary for the emergency stop device body 12 to be actuated, whereby it is possible to cause the emergency stop device body 12 to actuate more positively.

In contrast to this, when an abnormal speed during the descent of the car 5 has been detected by the governor 9 via the governor rope 10, a grasping mechanism for descent time 9*b* is actuated and grasps the governor rope 10, with the result that the circulation movement of the governor rope 10 is restrained. When in this state the car 5 is to descend further, the tension F1 toward the governor rope 10 shown in FIGS. 6 and 7 is generated in the governor rope 10 on the upper side as viewed from the lifting lever 14. And this tension F1 becomes stronger than the above-described prescribed tension in a balanced condition, that is, becomes stronger than the force with which the lifting lever 14 urged by the elastic element 16 is rotated.

Therefore, the balance between these forces becomes lost and the tension F1 overcomes the urging force of the elastic element 16, with the result that the governor rope 10 lifts upward the other side of the above-described letter L of the lifting lever 14 via the connecting portion 14*b*. That is, the lifting lever 14 rotates in the direction in which the roller 14*c* becomes spaced from the governor rope 10 (arrow A in FIG. 7).

Then the movable braking piece 19 slides upward along the first inclined surface 18*a* and bites into the gap between the first inclined surface 18*a* and the car guide rail 7 side face, and the movable braking piece 19 and the fixed braking piece 21 support the car guide rail 7 in a sandwiching manner, whereby the car 5 is braked.

In this embodiment, as the configuration of the emergency stop device which performs braking in both directions of ascent and descent directions, the configuration that, as shown in FIG. 2, the braking piece on one side as viewed from the car guide rail performs braking by biting in, is adopted. However, the scope of application of the present invention is not limited to this configuration. It is possible to apply any emergency stop device so long as the emergency stop device is such that a braking action to the ascent or descent direction is performed according to the rotation direction of a lifting lever, for example, cases where a roller is used in place of a braking piece, and braking pieces on both sides rather than one side bite in, and the like.

In addition, the description was given of the elevator equipped, in an upper part of the shaft, with a governor which detects an abnormal speed and grasps the governor rope. However, the present invention can also be applied to an elevator equipped with such a governor in a lower part of the shaft. In this case, because slackness occurs in the governor rope during the descent of the car, and not during the ascent thereof, it is necessary only that the lifting lever be configured to rotate so that the braking during descent by the safety gear is caused when this slackness occurs.

As an example of such a configuration, it is conceivable to adopt the configuration which involves arranging one side of the letter L of a lifting lever on the lower side substantially along a governor rope, attaching a roller to the forward end portion of this one side, and causing an elastic element to urge the lifting lever so that the lifting lever is rotated in the direction in which the roller is pushed against the governor rope.

The emergency stop device for elevators configured as described above is equipped with an endless governor rope which is provided in such a manner as to be capable of performing circulation movement in synchronization with the ascent and descent of a car; a governor which is provided in an upper part of the shaft, on which one side of the governor rope is wound, detects an abnormal speed of the car via the governor rope, and restrains the circulation movement of the governor rope when the abnormal speed is detected; an emergency stop device body which is provided in the car and brakes the car by being actuated when the abnormal speed is detected; a lifting lever that is an swinging body which is swingably provided in the emergency stop device body, connected to the governor rope, and rotates in the direction suited to the moving direction of the car when the circulation movement of the governor rope is restrained, thereby causing the emergency stop device body to actuate; and swinging body rotation means which rotates the swinging body (lifting lever) in a prescribed direction when the circulation movement of the governor rope is restrained and the governor rope between the car and the governor has become slack.

Therefore, even when the elastic deformation of the governor rope and the slackness of the governor rope by the displacement of the tension pulley occur, the lifting lever rotates at the same time with the occurrence of this slackness and it is possible to cause the emergency stop device body to actuate, with the result that it is possible to reduce actuation delays with a simple structure.

Prescribed tension is given by the tension pulley to the governor rope. The swinging body rotation means rotates the swinging body (lifting lever) in a prescribed direction when the circulation movement of the governor rope is restrained, the governor rope between the car and the governor has become slack and the tension of the governor rope in the slack portion has become weaker than the prescribed tension. The emergency stop device for elevators is further equipped with a roller which is rotatably provided in the swinging body (lifting lever) and abuts against the governor rope. The swinging body rotation means has an elastic element which urges the swinging body (lifting lever) so as to rotate in the direction in which the swinging body presses the roller against the governor rope. This elastic element is such that the urging force thereof is set so that the force with which the swinging body urged by this elastic element is rotated is balanced with the prescribed tension of the governor rope. The swinging body (lifting lever) is configured to be prevented from rotating by the balance between the above-described two forces in normal operating times.

For this reason, it is possible to obtain the effect of reducing the above-described actuation delays of the emergency stop device by a simple structure composed of a mechanical mechanism.

Industrial Applicability

The present invention can be applied to an emergency stop device for elevators which is actuated in both ascending and descending directions of a car by one governor which detects an abnormal speed in both ascending and descending directions.

DESCRIPTION OF SYMBOLS

1 shaft
2 traction machine
3 sheave
4 main rope
5 car
6 counterweight
7 car guide rails
8 hall
8*a* hall door
9 governor
9*a* grasping mechanism for ascent time
9*b* grasping mechanism for descent time
10 governor rope
11 tension pulley
11*a* tension weight
11*b* tension pulley fixed shaft
12 emergency stop device body
13 emergency stop frame
13*a* bolt
14 lifting lever
14*a* lever shaft
14*b* connecting portion
14*c* roller
14*d* long-holed portion
15 connecting shaft
16 elastic element
17 rope guide
18 holder
18*a* first inclined surface
18*b* second inclined surface
19 movable braking piece
19*a* pin portion
20 helical tension spring
21 fixed braking piece
22 pressing element

The invention claimed is:

1. An emergency stop device for elevators which actuates upon detection of an abnormal speed in both ascending and descending directions of a car and brakes the car against the direction of the abnormal detection, comprising:

an endless governor rope which is provided in such a manner as to be capable of performing circulation movement in synchronization with the ascent and descent of the car;

a tension pulley which is provided in either of the upper part or lower part of the shaft of an elevator and on which an end of the governor rope is wound to provide the governor rope with a prescribed tension;

a governor which is provided in the other of the upper part or lower part of the shaft, on which one side of the governor rope is wound, detects the abnormal speed via the governor rope, and restrains the circulation movement of the governor rope when the abnormal speed is detected, whereby the governor rope between the car and the governor becomes slack;

an emergency stop device body which is provided on the car and brakes the car by being actuated when the abnormal speed is detected;

a swinging body which is swingably provided in the emergency stop device body, connected to the governor rope, and which rotates in the direction suited to the moving direction of the car when the circulation movement of the governor rope is restrained, to cause the emergency stop device body to actuate; and a roller which is rotatably provided to the swinging body at a position to abut against the governor rope, an elastic element which urges the swinging body in such a manner as to rotate in the direction in which the swinging body presses the roller against the governor rope, wherein the rotation of the swinging body in said direction beyond the position where the roller presses against the governor rope causes the emergency stop device body to be actuated to brake the car, wherein the urging force of the elastic element is set such that the urging force of the elastic element is balanced with the prescribed tension of the governor rope, such that the swinging body does not rotate in said direction beyond the position where the roller presses against the governor rope having the prescribed tension, and wherein the swinging body is able to rotate in the direction beyond the position where the roller presses against the governor rope when the circulation movement of the governor rope is restrained, the governor rope between the car and the governor has become slack, and the tension of the governor rope in the slack portion has become weaker than the prescribed tension.

2. The emergency stop device for elevators according to claim 1, further comprising:

a rope guide which is rotatably provided in the emergency stop device body and abuts against the governor rope in a direction reverse to the direction in which the roller presses the governor rope.

* * * * *